United States Patent [19]

Renck et al.

[11] 3,959,061

[45] May 25, 1976

[54] APPARATUS AND METHOD FOR INSERTING MEMBRANE INTO CONTAINER LIDS

[75] Inventors: Lawrence E. Renck, Hoffman Estates; Matthew J. Bozinovich, Glenview, both of Ill.

[73] Assignee: Kraftco Corporation, Glenview, Ill.

[22] Filed: Oct. 24, 1974

[21] Appl. No.: 517,494

[52] U.S. Cl. ..... 156/262; 83/123; 83/125; 83/127; 113/80 D; 113/80 DA; 113/121 A; 156/264; 156/270; 156/293; 156/306; 156/528; 156/543

[51] Int. Cl.[2] ..... B32B 31/26; B32B 31/04; B65C 41/04; C09J 7/00

[58] Field of Search ..... 215/350; 113/80 DA, 113/80 D, 121 A; 29/451, 453, 235, 412; 83/123, 125, 127; 156/262, 264, 270, 306, 528, 521, 543, 556, 566, 293

[56] References Cited

UNITED STATES PATENTS

| | | | |
|---|---|---|---|
| 1,686,687 | 10/1928 | Edwards et al. | 113/80 D |
| 1,833,030 | 11/1931 | McClatchie | 113/80 D UX |
| 2,567,141 | 9/1951 | Andrew et al. | 113/80 D |
| 3,274,665 | 9/1966 | Higginson et al. | 29/453 X |
| 3,328,873 | 7/1967 | Schweers | 113/80 D X |
| 3,450,590 | 6/1969 | La Mers | 156/584 X |

*Primary Examiner*—William A. Powell
*Assistant Examiner*—Thomas Bokan
*Attorney, Agent, or Firm*—Fitch, Even, Tabin & Luedeka

[57] ABSTRACT

Apparatus and a method for inserting flexible liners into container lids. The apparatus includes a piston and means for actuating the piston in a reciprocal path. Means are provided for supporting a container lid in a position substantially normal to the reciprocal path of the piston at one end thereof. The piston has means affixed to the end of the piston nearest the interposed liner for moving a flexible liner interposed between the piston and the container lid into the container lid and for urging the liner into a flat position within the container lid.

9 Claims, 8 Drawing Figures

FIG. 1
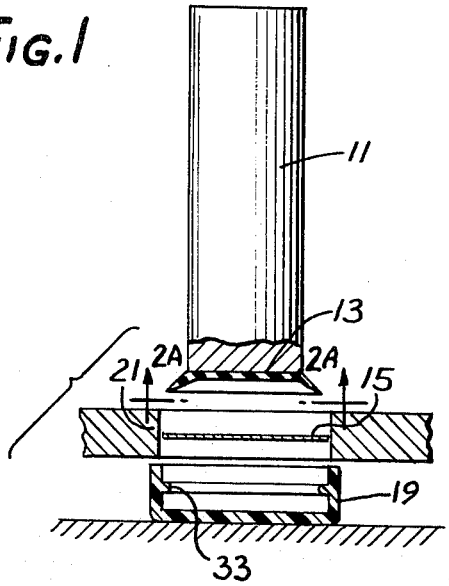
FIG. 2
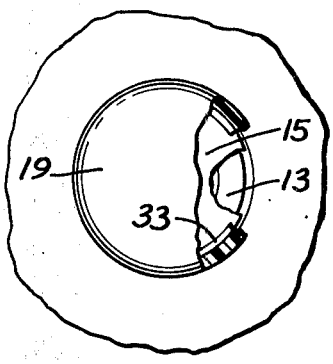
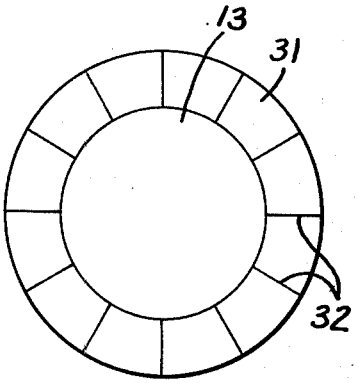
FIG. 2A
FIG. 3
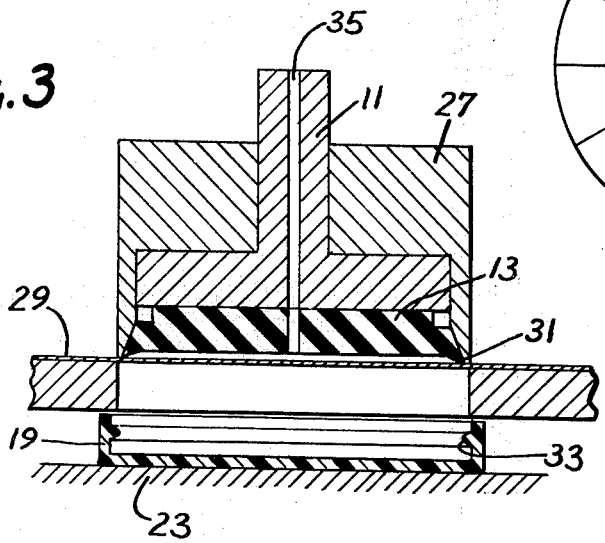
FIG. 4
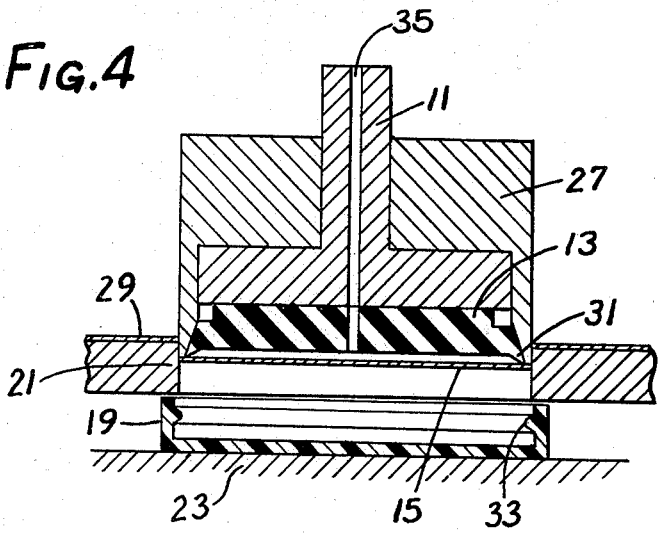

APPARATUS AND METHOD FOR INSERTING MEMBRANE INTO CONTAINER LIDS

The present invention relates generally to apparatus useful for inserting liners into container lids. More particularly, the present invention relates to apparatus for inserting flexible liners into container lids.

The use of various liner materials in container lids is well known. For example, it is known to insert rigid cardboard liners coated with a waxy substance into the interior of a container lid to provide a seal when the container lid is applied to a container. It is also known to coat the interior of the surface of container lids with a resilient material which effects a seal when the container lid is applied to a container.

Recent developments in respect to sealing containers have involved the use of heat sealable membranes. Heat sealable membranes are, of course, activated by the application of heat. The use of induction heating is a further recent development in connection with heating heat sealable membranes to activate the membrane and to provide a seal over the mouth of a container. In this method of heating, a heat sealable membrane in proximity to a metal source is placed over the mouth of a container. The container with the heat sealable membrane in place is positioned in proximity to an induction coil. The induction coil activates the metal and generates heat which seals the heat sealable membrane to the mouth of the closure.

Heat sealing of a heat sealable membrane over a container by induction heating requires that the heat sealing membrane be maintained in tight contact with the mouth of the container as the induction heating coil is energized. It would be desirable to insert the heat sealable membrane into a container lid which is applied to the container prior to effecting heating of the heat sealable membrane by induction heating or by other heating methods. However, heat sealable membranes are usually flexible materials and can not be inserted into container lids by use of known liner insertion apparatus. Container lids usually are provided with a container engagement flange or screw threads around the interior wall of the lid over which the membrane must be forced. This causes the edge of the membrane to curl upwardly and the membrane usually retains an upward curl after the insertion process has been finished. It would be desirable to provide apparatus and a method for effecting insertion of flexible membranes into container lids whereby the membrane is urged into a flat or non-curled position in contact with the interior surface of the container lid.

Accordingly, it is a principal object of the present invention to provide apparatus and a method for inserting flexible membranes into container lids. It is another object of the present invention to provide apparatus and a method for inserting flexible membranes into container lids whereby the flexible membrane assumes a flat position within the container lid. It is a further object of the present invention to provide apparatus and a method for inserting flexible membranes into container lids which is fast, efficient and adapted to high-speed operations.

These and other objects of the present invention will become more apparent from the following detailed description and the accompanying drawings wherein:

FIG. 1 is a cross-sectional view of apparatus useful in the present invention showing the relationship of the apparatus, a flexible membrane and a container lid;

FIG. 2 is a bottom view, partially broken away of FIG. 1;

FIG. 2A is a bottom view, of FIG. 1, taken along the line 2A—2A, showing a further embodiment of the invention;

FIGS. 3 through 6 show a further embodiment of the apparatus of the invention, depicting various sequential steps during operation of the apparatus of the invention.

Figure 5:
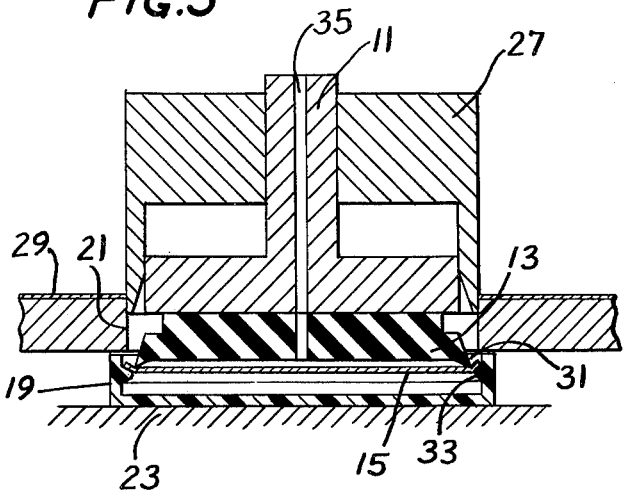
Figure 6:
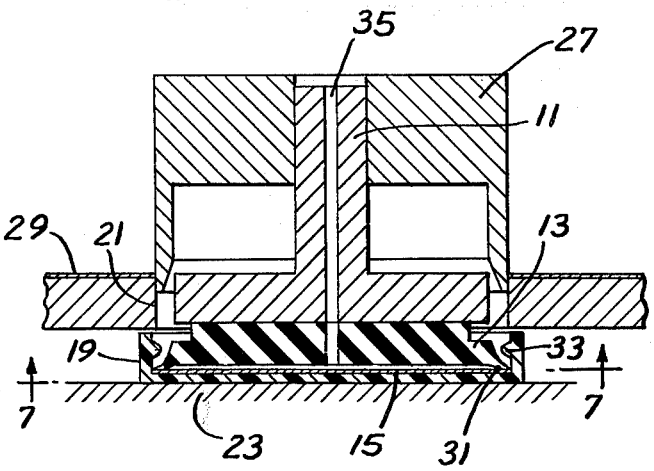

Generally, the present invention is directed to apparatus and a method for inserting flexible liners into container lids. The apparatus includes a piston and means for actuating the piston in a reciprocal path. Means are provided for supporting a container lid in a position substantially normal to the reciprocal path of the piston at one end thereof. The piston has means affixed to the end of the piston nearest the interposed liner for moving a flexible liner interposed between the piston and the container lid into the container lid and for urging the liner into a flat position within the container lid.

Referring now to the drawings, the apparatus of the invention is shown in FIG. 1. As shown in FIG. 1, the apparatus includes a piston 11, a member 13 affixed to one end of piston 11 and a container lid 19 disposed below piston 11. A liner 15 is interposed between the member 13 and container lid 19. A liner guide 21 retains the liner 15 in a path coexistent with the travel of piston 11. Means are provided for support of container lid 19. When the piston is moved downwardly, the member 13 moves the liner 15 in a path downwardly through liner guide 21 and into container lid 19. The member 13 also urges the liner 15 into a flat position within container lid 19. The member 13 is preferably a downwardly and outwardly protruding lip of resilient material affixed to piston 11. The resilient protruding lip of member 13, when compressed by movement of piston 11, moves outwardly along the periphery of the liner 15 and smooths and flattens liner 15 within container lid 19.

Further means (not shown) are provided for moving piston 11 in a vertical, reciprocal path from a top position to a bottom position. At the bottom position of piston 11, the protruding lip of member 13 is compressed outwardly from member 13.

A further embodiment of the present invention is shown in FIGS. 3 through 6. In this embodiment, piston 11 is disposed within a die 27. A continuous web of flexible liner material 29 is interposed between the die 27 and a container lid 19. Means 23 are provided for supporting the container lid 19. Means 23 is preferably a conveyor which moves a container lid 19 into position beneath the die 27. The piston 11 is provided with a member 13. Member 13 has a downwardly and outwardly depending lip 31.

In operation, the die 27 is actuated in a downward movement by means (not shown). The die 27 cuts a liner 15 (best seen in FIGS. 4, 5 and 6), from the liner web 29. The downward motion of die 27 is then terminated. Piston 11 is then actuated in a downward stroke by means (not shown). The member 13 moves the liner 15 through a liner guide 21 and into container lid 19. Further downward movement of piston 11 forces liner 15 past a container engagement flange 33 which is an integral part of container lid 19. As liner 15 moves passed restraining lip 33, the flexible nature of liner 15 causes liner 15 to curl upwardly. As piston 11 continues in its downward stroke, the protruding lip 31 of member 13 moves liner 15 into contact with container lid 19. As the downward stroke of piston 11 continues, the protruding lip 31 of member 13 is compressed outwardly and urges liner 15 into flat contact with container lid 19.

In a preferred embodiment of the present invention, member 13 and protruding lip 31 are formed of a single piece of resilient material. The protruding lip 31 is provided by removing material from a solid piece of resilient material or by casting the resilient material in a concave shape. The member 13 may be formed of any suitable resilient material and suitable materials include, but are not limited to, rubber, metal, polyurethane, nylon, polyethylene, polyproylene, polyamides and polyesters.

In a further embodiment of the present invention, as shown in FIG. 2A, the protruding lip 31 of member 13 may be provided with a plurality of slits 32. The slits 32 aid in compression and outward movement of the lip 31 and are desirable for use with some resilient materials.

A vent 35 may be provided in piston 11. The vent 35 extends through piston 11 and through member 13. The vent acts to relieve any pressure which is built up during the downward stroke of piston 11. In a further embodiment of the apparatus, vacuum means, (not shown) may be attached to vent 35. When vacuum is drawn through vent 35, it aids in holding liner 15 in close contact with piston 11.

After piston 11 has reached the bottommost position of its stroke, the piston 11 is moved upwardly to its first position. The die 27 is also moved upwardly to its first position. Means (not shown) are provided to move liner web 29 in timed relation to the movement of die 27 and piston 11 to a position wherein a further liner 15 may be cut from liner web 29 on a subsequent downward stroke of die 27. Means (not shown) are also provided for moving a subsequent container lid 19 in timed relation to the movement of die 27 and piston 11 into position beneath die 27 and piston 11.

Figure 7:
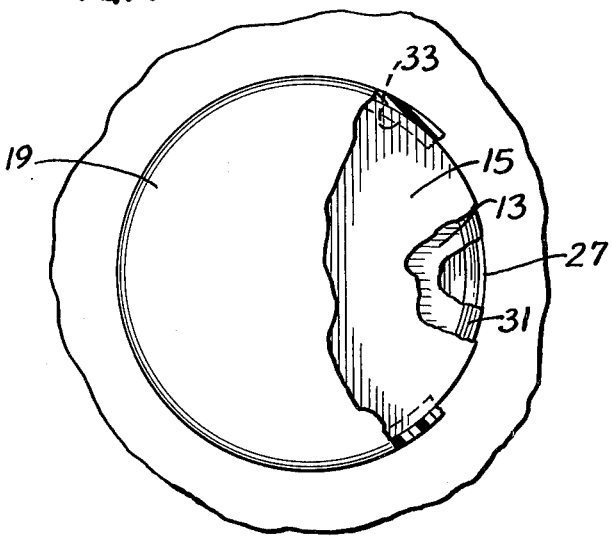
FIG. 7 is a bottom view, partially broken away, of FIG. 6.

As shown in FIGS. 2 and 7, the apparatus of the invention is used to insert circular liners into circular caps. It should be understood, however, that the apparatus is equally suitable for insertion of non-circular, i.e., square, rectangular, hexagonal, elliptical, etc. liners into noncircular caps.

While the apparatus of the invention has been particularly shown and described in a verticle orientation, it should be understood that other orientations, including horizontal and reverse verticle, may also be used.

The apparatus of the present invention is adapted to high speed operation and is capable of providing continuous means for inserting flexible liners into container lids. Various modifications may be made in the apparatus of the present invention without departing from the scope of the invention which is defined in the appended claims.

What is claimed is:

1. Apparatus for inserting a flexible liner into container lids comprising a piston, means for actuating said piston in a reciprocal path, means for supporting a container lid in a position substantially normal to said reciprocal path of said piston at one end thereof, means for interposing a flexible liner between said piston and said container lid and resilient means affixed to the end of said piston nearest said interposed liner for moving said interposed liner along said reciprocal path and for urging said flexible liner into a flat position within said container lid, said resilient means being a lip of resilient material extending outwardly from the periphery of said piston.

2. Apparatus in accordance with claim 1 wherein said lip of resilient material has a plurality of radial slits spaced around the periphery of said lip.

3. Apparatus in accordance with claim 1 wherein said container lid has a container engagement flange extending around the interior wall of said lid over which said flexible liner is forced.

4. Apparatus in accordance with claim 1 wherein vent means extend through said piston.

5. Apparatus in accordance with claim 4 where said vent means is in fluid communication with vacuum means.

6. Apparatus in accordance with claim 1 wherein said piston means is disposed within die means and a continuous web of flexible liner material is interposed between said die means and said container lid.

7. A method for inserting flexible liners into container lids comprising providing a piston moveable in a reciprocal path, supporting a container lid in a position substantially normal to the reciprocal path of said piston at one end thereof, interposing a flexible liner between said piston and said container lid, said piston including a resilient lip extending outwardly from the periphery of said end of said piston nearest said interposed liner and moving said piston in said reciprocal path so that said resilient lip urges said flexible liner into a flat position within said container lid.

8. A method in accordance with claim 7 wherein said container lid has a container engagement flange extending around the interior wall of said lid and said flexible liner is forced over said flange and is urged into flat position within said container lid by compression of said resilient lip.

9. A method in accordance with claim 7 wherein said reciprocal path of said piston extends at the end adjacent said container lid a distance sufficient to cause contact of said resilient lip with said container lid and to compress said resilient lip, said compression urging said flexible liner into a flat position at the periphery of said container lid.

* * * * *